US012709375B2

(12) United States Patent
Breton

(10) Patent No.: US 12,709,375 B2
(45) Date of Patent: Aug. 18, 2026

(54) REMOVABLE REMOTELY CONTROLLABLE DEVICE FOR ROTATING THE STEERING WHEEL OF A BOAT OF THE LIKE

(71) Applicant: GESTION LOGISCASA INC., Quebec (CA)

(72) Inventor: Daniel Breton, Quebec (CA)

(73) Assignee: GESTION LOGISCASA INC., Quebec (CA)

( * ) Notice: Subject to any disclaimer, the term of this patent is extended or adjusted under 35 U.S.C. 154(b) by 742 days.

(21) Appl. No.: 18/172,038

(22) Filed: Feb. 21, 2023

(65) Prior Publication Data

US 2024/0278896 A1 Aug. 22, 2024

(51) Int. Cl.
*B63H 25/52* (2006.01)
*B63H 25/02* (2006.01)

(52) U.S. Cl.
CPC ..... *B63H 25/52* (2013.01); *B63H 2025/028* (2013.01)

(58) Field of Classification Search
CPC ..... B63H 25/52; B63H 2025/028; B63H 2025/022; B62D 15/025
See application file for complete search history.

(56) References Cited

U.S. PATENT DOCUMENTS 3,002,398 A 10/1961 Beamer
3,648,539 A 3/1972 Rouis
4,151,807 A 5/1979 Black, Jr.
4,244,316 A 1/1981 Kulischenko
4,262,618 A 4/1981 VanDerZee
4,453,485 A 6/1984 Houghton-Brown et al.
5,615,581 A 4/1997 Cordioli
7,628,239 B1 12/2009 Louie et al.
8,051,936 B1 11/2011 Herbert et al.
10,384,709 B2 8/2019 Joughin
11,091,192 B2 8/2021 McMickell et al.
11,820,356 B2 * 11/2023 Gugler ..... B60W 10/04
2008/0288142 A1 11/2008 Ewert
2018/0201299 A1 7/2018 Ashtari

FOREIGN PATENT DOCUMENTS

EP 0671320 A1 9/1995

* cited by examiner

*Primary Examiner* — Andrew Polay
(74) *Attorney, Agent, or Firm* — Agence de Brevets Fournier

(57) ABSTRACT

A removable remotely controllable device for rotating a steering wheel having an outer edge includes a body, first and second wheels or similar rotating elements that are mounted to the body and that defines with the body hooks for mounting the body on the steering wheel via its outer edge, at least one of the two wheels being motorized. The body is configured to hang on the front of the steering wheel while the first and second wheels are operatively mounted onto the outer edge of the steering wheel for transmission of rotation of the motorized wheel thereto. The device further includes a controller mounted to the body and operatively coupled to the at least one motorized wheel for controlling the motorized wheel.

27 Claims, 7 Drawing Sheets

REMOVABLE REMOTELY CONTROLLABLE DEVICE FOR ROTATING THE STEERING WHEEL OF A BOAT OF THE LIKE

FIELD

The present disclosure relates to pleasure boats and more specifically to a removable remotely controllable device for rotating the steering wheel of a boat or the like.

BACKGROUND

It is well known that some types of vehicles, such as farm vehicles, can be equipped with automatic steering system to automatically steer along a predetermined path.

In the case of marine vehicles, many systems exist that allow remotely control the steering of a boat. Among the most well-known systems are remote-controlled steering device for outboard vehicles, such as the one described in U.S. Pat. No. 3,002,398, issued on Oct. 3, 1961, to Beamer. Such system is configured for mounting to an outboard motor and is used mainly when a single passenger is in the boat and that such passenger wishes to do some trailing fishing. The system is, however, not adapted for a boat equipped with a steering wheel.

In U.S. Pat. No. 4,262,618, issued on Apr. 21, 1981, and titled "Remote Control Steering Attachment for a Steering Wheel", VanDerZee proposes a variation on the system by Beamer, which can be mounted to a steering wheel via an attachment assembly, which includes a cross member that is releasably mountable to the steering wheel of a boat. However, the cross member requires fasteners for its mounting, which may take some times and a minimum of dexterity to install.

In U.S. Pat. No. 5,615,581, issued on Apr. 1, 1997. and titled "Remotely Controlled Device for Rotating the Steering wheel of a Motor Vehicle and then Taking it Back to the Starting Position", Cordioli teaches a system that can be coupled to a steering wheel via an assembly of hook-shaped jaws. A drawback of such system is that the assembly is not readily mountable on a steering wheel, is very complex and therefore costly to manufacture, and is not compatible with different types of steering wheels.

Other systems or mechanisms exist that are even more difficult to install, as they are mountable directly to the steering shaft. An example of such a system is described by Kulischenko in U.S. Pat. No. 4,244,316, issued on Jan. 13, 1981, and titled "Marine Vessel Safeguard Steering Mechanism".

SUMMARY

According to an illustrative embodiment, there is provided a removable remotely controllable device for rotating a steering wheel having an outer edge, the device comprising:

a body;

first and second rotating elements that are mounted to the body and that defines with the body hooks for mounting the body on the steering wheel via its outer edge; at least one of the two rotating elements being motorized; the body being configured for resting on the front of the steering wheel while the first and second rotating elements are operatively mounted onto the outer edge of the steering wheel for transmission of rotation of the rotating elements to the steering wheel; and a controller mounted to the body and operatively coupled to the at least one motorized rotating element for controlling the least one motorized rotating element.

According to another illustrative embodiment, there is provided a removable remotely controllable device for rotating a steering wheel having an outer edge, the device comprising:

a body;

first and second wheels that are mounted to the body and that defines with the body hooks for mounting the body on the steering wheel via its outer edge; at least one of the two wheels being motorized; the body being configured for resting on the front of the steering wheel while the first and second rotating elements are operatively mounted onto the outer edge of the steering wheel for transmission of rotation of the rotating elements to the steering wheel; the first and second wheels being selected from the group consisting of U-shaped wheels and V-shaped wheels;

at least one friction-reducing element, mounted to the body via an arm that extends downwardly from the body so that the at least one friction-reducing element is substantially laterally centered between the first and second wheels, for contacting the steering wheel when the body rests on the front of the steering wheel; the distal end of the arm including an attaching element;

a compartment that is removably mountable to the attaching element of the arm;

a controller that is housed in the compartment and that is connectable to the at least one motorized wheel for controlling the least one motorized wheel; and a battery that is housed in the compartment and that is connected to the controller for powering the controller and the at least one motorized wheel via the controller.

According to still another illustrative embodiment, there is provided a removable universal controller for a steering wheel, the controller comprising:

a body having rotating elements for hanging the body onto the rim of the steering wheel and for rotating the steering wheel; at least one of the rotating elements being remotely controllable.

Other objects, advantages and features of the removable remotely controllable device for rotating a steering wheel will become more apparent upon reading the following non-restrictive description of preferred embodiments thereof, given by way of example only with reference to the accompanying drawings.

DETAILED DESCRIPTION

Figure 1:
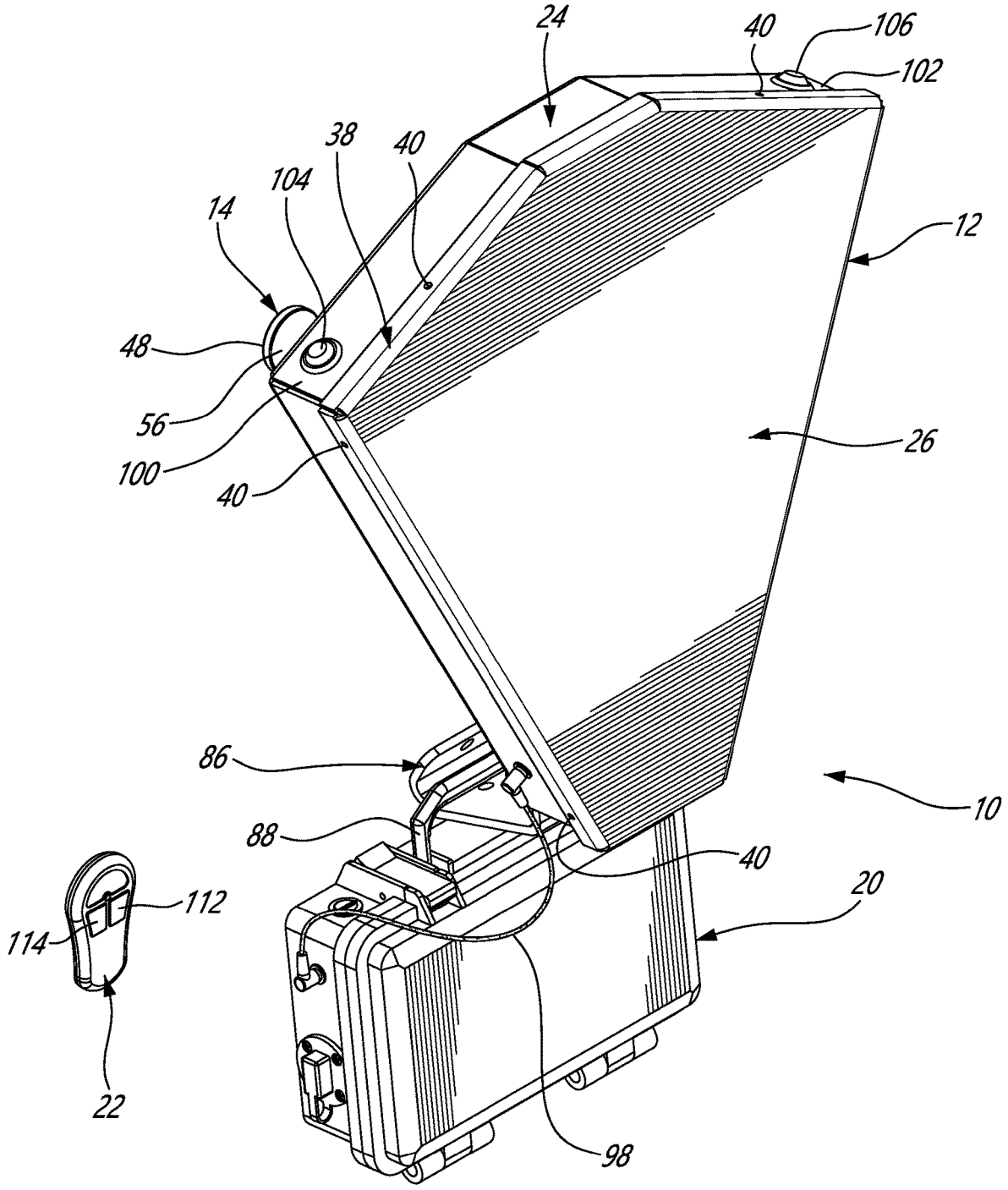
FIG. 1 is a front perspective view of a removable remotely controllable device for rotating a steering wheel according to an illustrative embodiment.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

A removable remotely controllable device 10 for rotating a steering wheel 11 according to an illustrative embodiment will be described with reference to FIGS. 1 to 6.

The device 10 comprises a body 12, first and second motorized wheels 14 and a friction-reducing element 16, all mounted to the body 12, a controller 18 housed in a briefcase 20, for connecting to the first and second motorized wheels 14 for their control, and a remote control 22 for remotely controlling the first and second motorized wheels 14 via the controller 18.

As will become more apparent upon reading the following description, the motorized wheels 14 defines hooks with the body for mounting the body 12 on the steering wheel 11 via the upper edge 23 of its rim 13 so that the body 12 rests on the front of the steering wheel 11 while the motorized wheels 14 transmits their rotation to the steering wheel 11.

A person skilled in the art will now appreciate that the body 12 can be readily mounted to the steering wheel 11 simply by placing the wheels 14 onto the steering wheel 11, the body 12 contributing to adding weight to the overall device to add friction on the motorized wheels 14 so as to better their transmission of rotational movement to the steering wheel 11. As such, no tools or adjustment of either the device 10 or steering wheel 11 are required for installing the device 10.

Also, as will also become more apparent hereinbelow, the fact that the device 10 can be installed simply by placing the motorized wheels 14 on the upper portion 23 of the steering wheel 11 allows using the same device 10 on different configurations of steering wheels, none withstanding their configuration within their outer edge 23, the minimum diameter of steering wheels that can be accommodated by the device 10 depending on the distance between both motorized wheels 14. As such, the device 10 can be seen as being universal.

The body 12 is in the form of a generally triangular-shaped casing 24, which is closed by a complementary shape cover 26. More specifically, the casing 24 has a peripheral wall 28, defining the thickness of the casing 24, and a bottom 30, defining the back wall of the device 10 when it is mounted on the steering wheel 11, and the cover 26 defining the front wall thereof. The peripheral wall 28 includes a generally flatten C-shaped top portion 32, a relatively smaller bottom portion 34 that is centered with the top portion 32, and two elongated side portions 36 connecting the top and bottom portions 32-34 of the peripheral wall 28.

The cover 26 has a peripheral rim 38 that allows to removably attach the cover 26 to the box using fasteners 40.

The cover 26 can be secured to the casing 24 using other means than fasteners and can also be pivotably or slidably mounted to the casing 24.

The shape of the casing 24 is dictated by the relative positions of the components housed therein but is not limited to such illustrative embodiment. The casing 24 can have any other configuration and size, allowing mounting the motorized wheels 14 and friction reducing element 16 thereto and the other components therein as will be described hereinbelow in more detail. For example, the casing 24 can be rectangular, round, or else. Its thickness may also vary along its length and width.

The top portion of the back wall 30 includes a rounded elongated opening 42, which defines a handle for the casing 24. According to another illustrative embodiment, the handle is in the cover 26 and/or takes another form than an opening.

Figure 5:
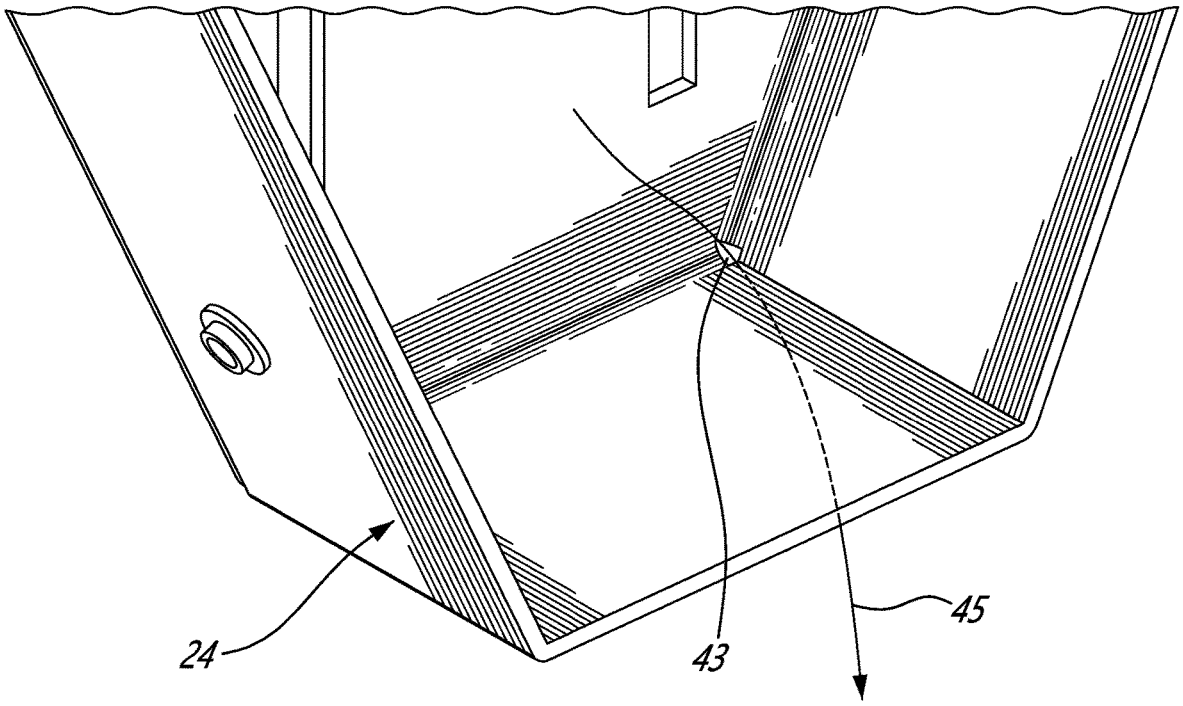
FIG. 5 is a front perspective close-up view of the device from FIG. 1, shown without the back cover and showing one of the drain holes of the main body.

Turning now briefly to FIG. 5, the bottom of the casing 24 is also provided with two drain holes 43 (only one shown). The drain holes 43 are located, for example, in both lower corners of the casing 24 and allows evacuating any excess water that could enter the casing 24 during use on a boat (not shown) (see arrow 45).

According to another illustrative embodiment (not shown), the number, location and configuration of the drain holes are different than illustrated.

Each of the first and second motorized wheels 14 are mounted to the casing 24 near respective top corner 44 and 46 thereof.

Figure 3:
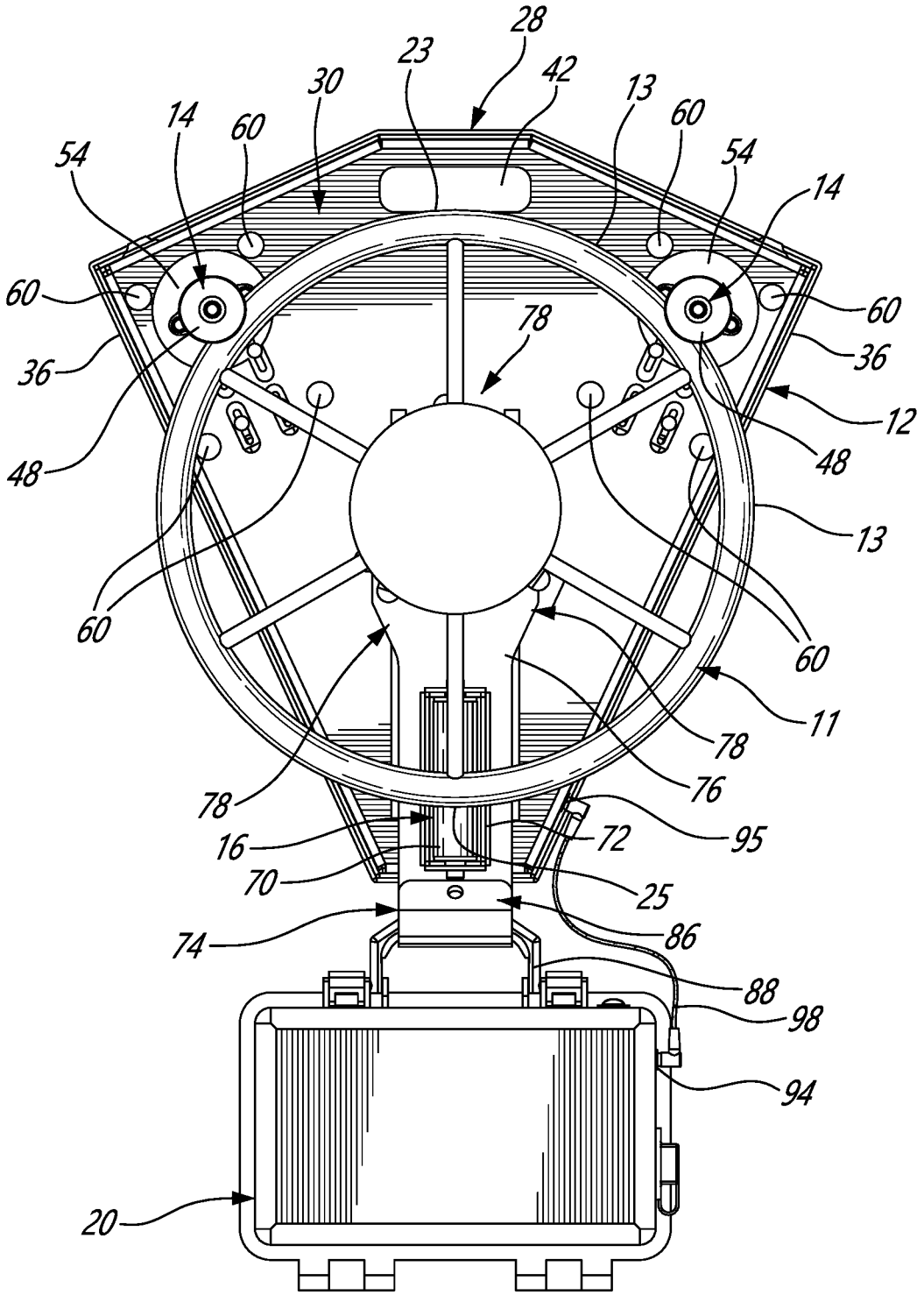
Figure 4:
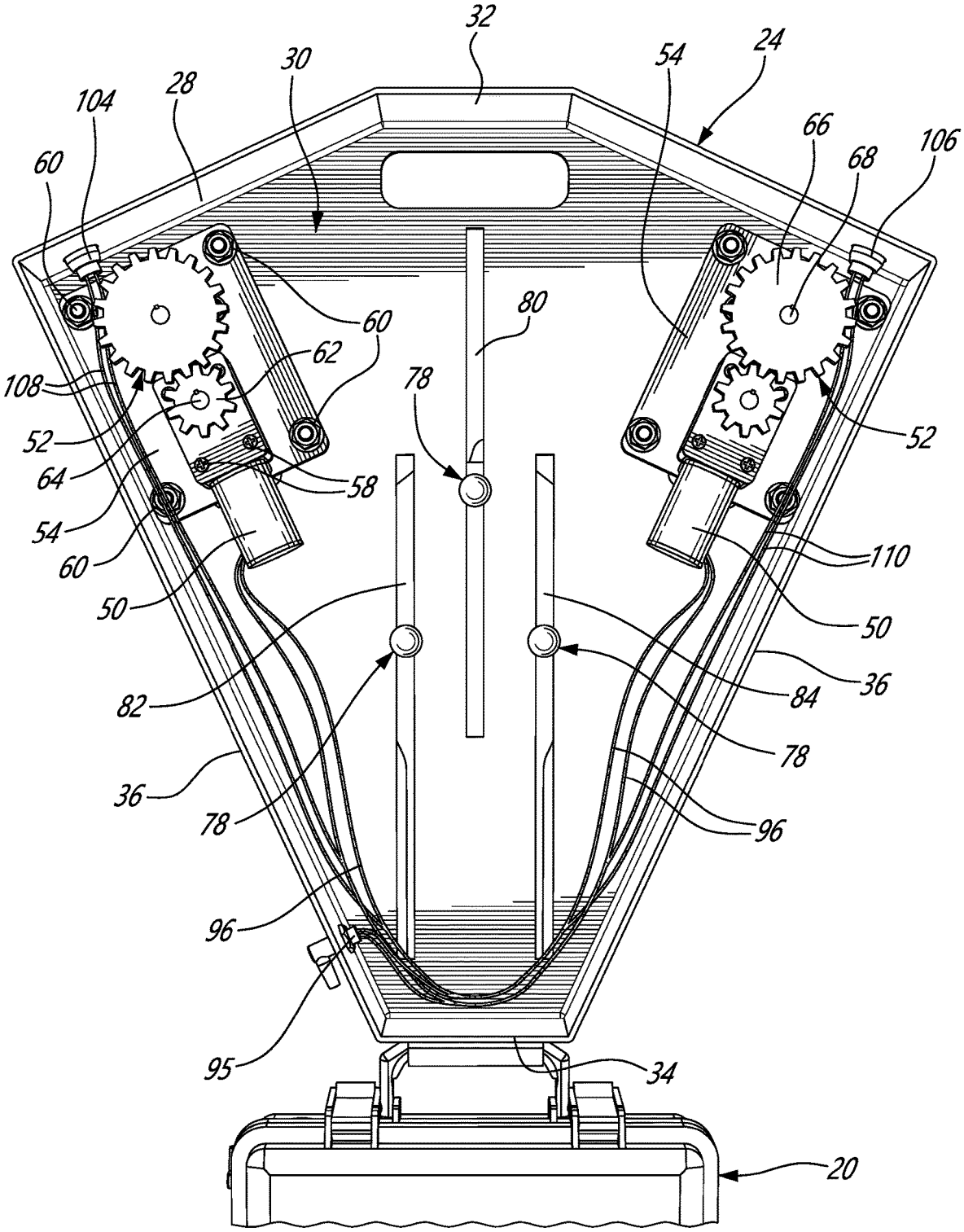
FIG. 4 is a front close-up elevation view similar to FIG. 2, showing the main body without the cover.

With reference more specifically to FIGS. 3 and 4, each of the motorized wheels 14 includes a U-shaped wheel 48, operatively mounted to a rotary actuator 50, via a mechanical drivetrain 52, both secured in the casing 24 on the bottom 30 thereof via a mounting plate 54.

The U-shaped wheel 48 is adapted to receive therein the outer edge 23 of the steering wheels 11 of various thickness and geometry. For example, the central groove 56 of the wheel 48 is tapered. According to another illustrative embodiment, the wheel 48 has another configuration, such as V-shaped, flat rim or concave. The diameter of the wheel 48 may also be different than illustrated.

The wheel 48 is made of metal and can be covered or rubber or of another friction-promoting material (not shown).

The rotary actuator 50 is secured to the mounting plate 54 using fasteners 58. According to another illustrative embodiment (not shown), the actuator 50 is secured to the mounting plate 54 using other fastening means, mechanism or assembly. According to still another illustrative embodiment, the rotary actuator is secured directly to the casing 24.

The plate 54 is secured to the casing 24 using fasteners 60. According to another illustrative embodiment (not shown), the plate 54 is secured to the casing 24 by welding or using other fastening means, mechanism or assembly.

The mechanical drivetrain 52 comprises a first gear 62 fixedly mounted to the output shaft 64 of the rotary actuator 50 and a second gear 66, wider than the first gear 62, that is mounted to the axle 68 of the U-shaped wheel 48 and operatively coupled to the first gear 62.

According to another illustrative embodiment (not shown), the number and size of the gears of the drivetrain 52 can be different than illustrated. According to still another illustrative embodiment, the drivetrain 52 has another configuration than illustrated, allowing to operatively couple the rotary actuator 50 and the wheel 48. According to yet another illustrative embodiment, the drivetrain 52 is omitted and the wheel 48 is directly mounted to the rotary actuator 50.

According to another illustrative embodiment (not shown), only one of the two wheels 14 is motorized, the other being simply driven by the rotation of the steering wheel 11 and acting as a balancing support for the body 12.

The rotary actuator 50 is not limited to any type, size and configuration.

With reference now to FIGS. 3 and 4, the friction-reducing element 16 includes of a roller 70 that is rotatably mounted to a mount 72. The mount 72 is slidably mounted to the back wall 30 of the casing 24 via a mounting arm 74 so that both the arm 74 and roller 70 are generally laterally centered with both motorized wheels 14, while extending downwardly from the casing 24.

The arm 74 includes an enlargement 76, which defines the upper end thereof, and which receives three (3) handle knob screws 78 in a generally triangular configuration therein. The back wall 30 of the casing 24 is provided with three (3) parallel slots 80-84, each for receiving a respective screw 78. A person skilled in the art will now appreciate that such an arrangement of the arm 74, screws 78 and slots 80-84 allows slidably adjusting the position of the arm 74 relative to the casing 24 so as to yield a friction-reducing abutment for the lower portion 25 of the steering wheel 11 when the device 10 is mounted thereto, which allows adapting the device for steering wheels of different diameter.

Figure 7:
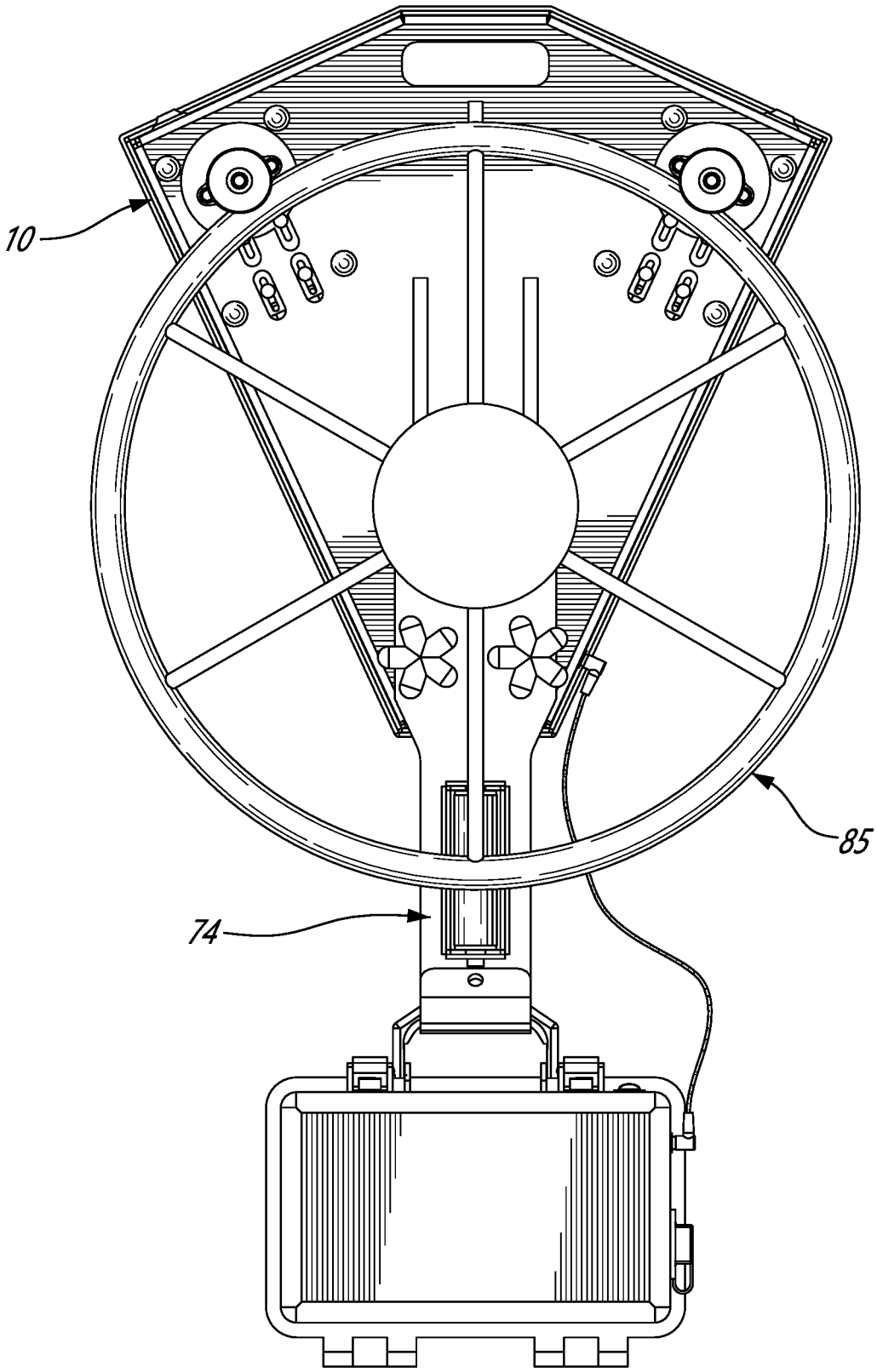
FIG. 7 is a rear elevation view of the device from FIG. 1, shown without the remote control and mounted to a wide steering wheel.

FIG. 7 shows the device 10 mounted to a wider steering wheel 85 than the steering wheel 11 and wherein the arm 74 has been lowered accordingly as described hereinabove.

According to another illustrative embodiment, the roller 70 can have another configuration than illustrated or be mounted to the casing 24 differently than illustrated. For example, the roller 70 can be fixedly mounted to the casing 24.

Another friction-reducing element 16 than a roller 70 can also be provided, such as a fixed element (not shown). According to another illustrative embodiment (not shown), the friction-reducing element is omitted.

More than one friction-reducing element 16 can also alternatively be provided for contacting the steering wheel 11 and/or be differently positioned on the casing 24 and relative to the wheels 14 than illustrated.

The lower end portion 86 of the arm 74 defines a hook, which is adapted to receive and support the briefcase 20 via its handle 88 so that the weight of the briefcase 20 contributes to adding weight onto the wheels 14 and therefore friction between the wheels 14 and the steering wheel 11, thereby improving adherence therebetween. This has been found to prevent slippage therebetween and therefore improve the precision of the control of the steering wheel 11.

Figure 6:
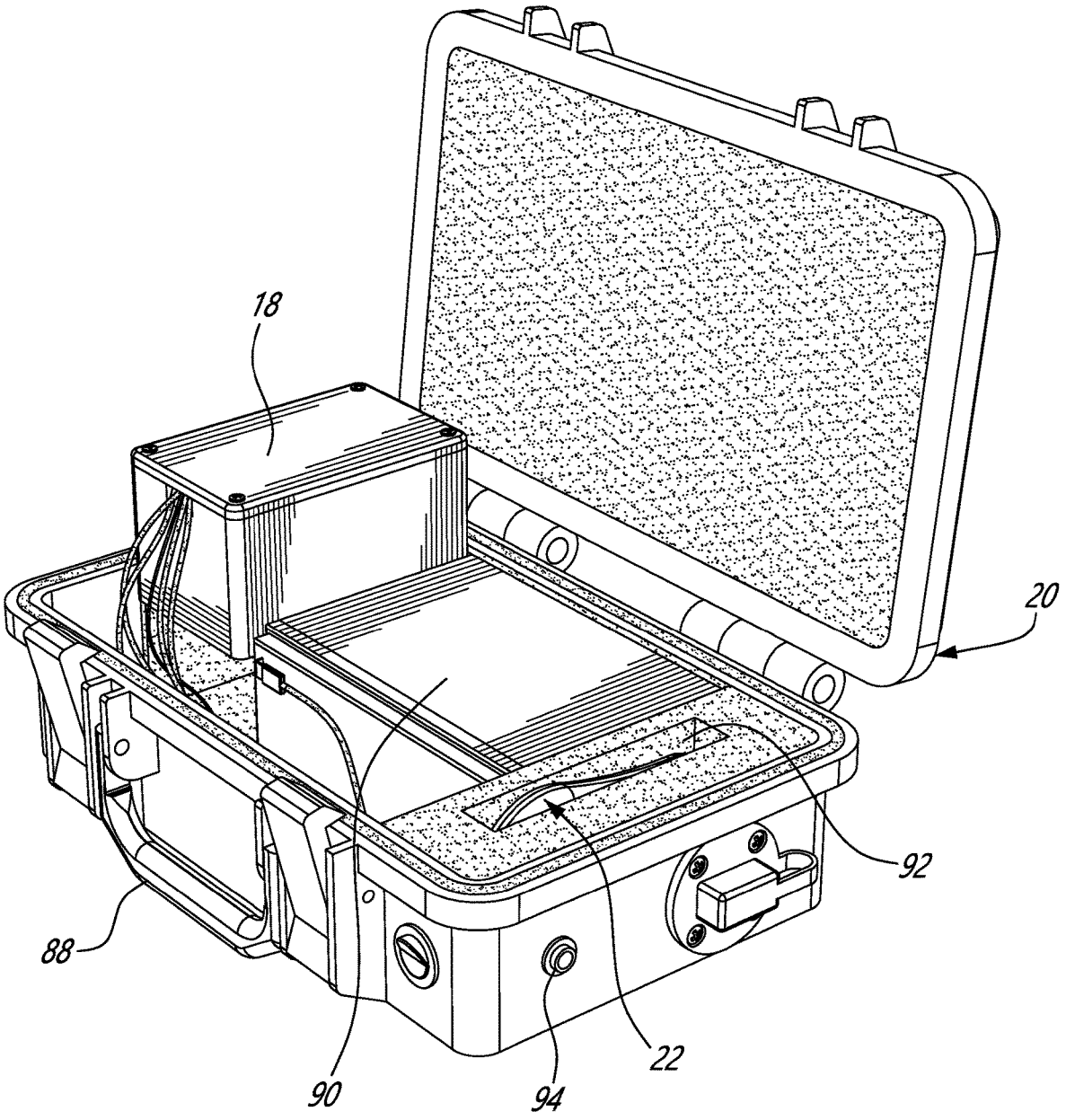
FIG. 6 is a perspective view of the briefcase of the device from FIG. 1; showing the briefcase opened.

With reference to FIG. 6, the briefcase 20 houses the controller 18, a battery 90 connected to the controller 18 for energizing the controller 18 and the motorized wheels 14 via the controller 18. The briefcase 20 further includes a compartment 92 for receiving the remote control 22 for its storage when the device 10 is not in use.

The briefcase 20 further comprises a connecting port 94, that is accessible from the outside of the briefcase 18 and that is wired to the controller 18 for allowing the connection to the body 12 and more specifically to the motorized wheels 14, so that they can be controlled by the controller 18. For that same purpose, the body 12 is provided with a connecting port 95, that is connected to both motorized wheels 14 via wires 96, and that allows connecting the body 12 to the controller 18 using a removable cable 98.

The cable 98 and connecting ports 94-95 can be of the RCA type as illustrated or of another type.

The top corners 100-102 of the casing 24 are provided with respective indicator lights 104-106, which provide, in use of the device 10, a visual indication of the rotational direction of the steering wheel 11, depending on the rotational direction of the motorized wheels 14.

The indicator lights 104-106, which can be for example LEDs or other type of lights, are connected to the port 95 via wires 108-110, allowing their connection to the controller 18, similarly to the motorized wheels 14.

As can be seen for example in FIGS. 1 and 3 and as mentioned hereinabove, the hook portion 86 of the arm 74 allows receiving the briefcase 20, thereby positioning it sufficiently near the body 12 for their interconnection using the cable 98. Thus positioned, the briefcase 20 with the controller 18 and, above all, the battery 90 therein, add further weight to the body 12 and therefore improve friction between the wheels 14 and steering wheel 11, to promote adherence therebetween.

According to the illustrative embodiment, the battery 90 is of the lead type to increase the weight on the wheels 14. According to another illustrative embodiment, the battery is of another type.

The controller 18 is configured for wireless communication with the remote control 22 and for energizing the motorized wheels 14 and the indicator lights 104 and 106 in accordance with the signals received from the remote control.

It is to be noted that any of the illustrated wire connections can be replaced by wireless connections and vice versa.

According to another illustrative embodiment (not shown), any one or both of the controller 18 and battery 90 can be integrated in the casing 24.

The controller 18 can be configured for connection to and wireless control by a smartphone or computer via a dedicated application or program.

The configuration and programming of such an application or program will not be described herein since it is believed to be within the reach of a skilled programmed to conceive such an application or program.

The configuration and programming of the controller 18 are also believed to be within the reach of a person skilled in the art.

In operation of the device 10, the body 12 is mounted to the steering wheel 11 simply by placing the wheels 14 on the upper edge 23 of its rim 13. Before or after this step, the position of the arm 74 can be adjusted so that the lower portion of the steering wheel 11 is in contact with the roller 70. Also, it has been found that the lower the position of the briefcase 20 hung to the hook portion 86, the greater the stability of the body 12 as a result of a lever effect.

The briefcase 20 is then hung to the hook portion 86 of the arm 74 and connected to the body 12, as described hereinabove. The handle portion 42 of the casing 24 can be used to that effect. Also, the weight onto the body 12 will cause the body 12 to self-balance onto the steering wheel 11.

Figure 2:
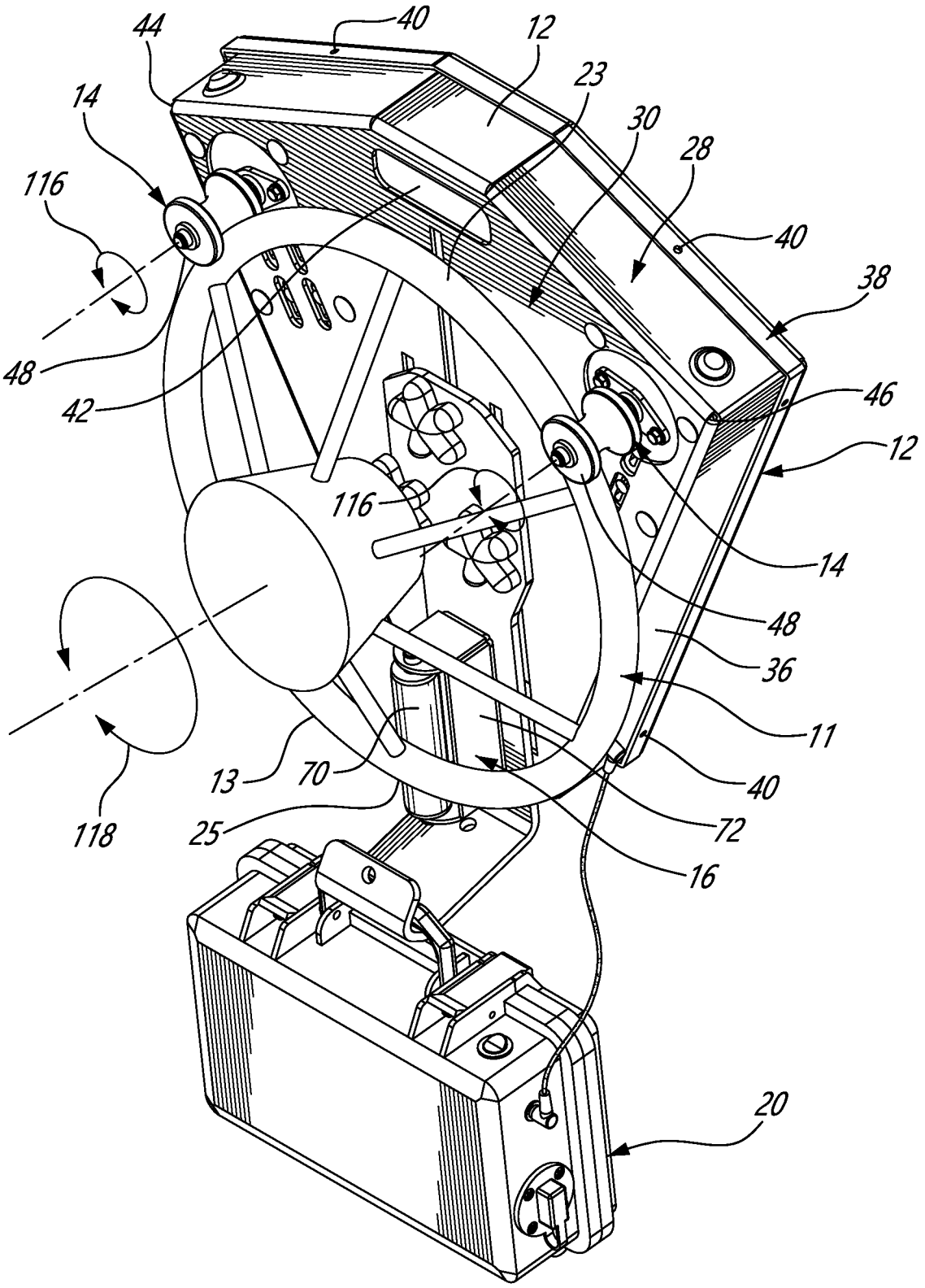
FIGS. 2 and 3 are respectively rear perspective and elevation views of the device from FIG. 1, shown without the remote control and mounted to a small steering wheel.

The remote control 22, which is provided with right and left buttons 112 and 114, can then be used to cause via these buttons 112-114, to command the rotation of the motorized wheels 14 (see arrows 116 in FIG. 2) to cause the rotation of the steering wheel 11 in the corresponding direction (see arrow 118 in FIG. 2).

The remote control 22 can further be equipped with accelerometers or with other sensors allowing to detect the position and orientation of the remote control 22 relative to the body so as to reverse the function of the left and right buttons 114 and 112 thereof to allow the user (not shown) a more intuitive use of the remote control 22 according to its orientation relative to the body 12, and therefore of the steering wheel 11.

After or while being used, the body 12 can be readily removed from the steering wheel 11 by raising it therefrom, using for example the handle 42.

It is to be noted that many modifications could be made to the removable remotely controllable device 10 described hereinabove and illustrated in the appended drawings. For example:

while the device 10 is described as having wheels 14, other rotating elements, such as small endless belt assemblies can alternatively or additionally be used;

the device is not limited to be used on a boat and can be mounted on any steering wheel for its remote controlling.

Although a removable remotely controllable device for rotating the steering wheel of a boat of the likes has been described hereinabove by way of illustrated embodiments thereof, it can be modified. It is therefore to be understood that numerous modifications may be made to the illustrative embodiments and that the scope of the claims should not be limited by the illustrative embodiments but should be given the broadest interpretation consistent with the description as a whole.

What is claimed is:

1. A removable remotely controllable device for rotating a steering wheel having an outer edge, the device comprising:

a body;

first and second rotating elements that are mounted to the body and defining hooks with the body for mounting the body on the steering wheel via the outer edge of the steering wheel; at least one of the two rotating elements being motorized; the body being configured for resting on the front of the steering wheel while the first and second rotating elements are operatively mounted onto the outer edge of the steering wheel for transmission of rotation of the rotating elements to the steering wheel; each of the first and second rotating elements including a wheel; and a controller mounted to the body and operatively coupled to the at least one motorized rotating element for controlling the least one motorized rotating element.

2. The device as recited in claim 1, further comprising at least one friction-reducing element mounted to the body on a same side thereof than the first and second rotating elements for contacting the steering wheel when the body rests on the front of the steering wheel.

3. The device as recited in claim 2, wherein the at least one friction-reducing element includes a roller.

4. The device as recited in claim 1, wherein the controller is removably mounted to the body.

5. The device as recited in claim 4, wherein the controller is housed in a compartment.

6. The device as recited in claim 5, wherein the compartment and the body include first and second connecting ports respectively, each connected to the controller and to the motorized rotating element respectively for the interconnection of the controller and the at least one motorized rotating element via a removable connector.

7. The device as recited in claim 1, further comprising a remote control for controlling the at least one motorized rotating element via the controller.

8. The device as recited in claim 1, wherein the body includes a handle.

9. The device as recited in claim 1, wherein the wheels or the first and second rotating elements are selected from the group consisting of U-shaped and V-shaped wheels.

10. The device as recited in claim 1, wherein the body includes a casing having upper and lower sides and front and back sides; the first and second rotating elements being mounted to the casing on the back side thereof near the upper side thereof.

11. The device as recited in claim 10, further comprising at least one friction-reducing element mounted to the casing on a back side thereof for contacting the steering wheel when the body rests on the front of the steering wheel.

12. The device as recited in claim 11, wherein the at least one friction-reducing element mounted to the casing via an arm that extends from the casing downwardly from the lower side thereof so that the at least one friction-reducing element is substantially laterally centered between the first and second rotating elements.

13. The device as recited in claim 11, wherein the at least one friction-reducing element is mounted slidably mounted to the casing so that a distance of the at least one friction-reducing element from the first and second rotating elements can be adjusted.

14. The device as recited in claim 11, wherein the at least one friction-reducing element includes a roller.

15. The device as recited in claim 12, wherein a distal end of the arm is provided with a hook.

16. The device as recited in claim 15, wherein the controller is removably mounted to the casing via the hook.

17. The device as recited in claim 16, wherein the controller is housed in a compartment having a handle so that the compartment can be hung from the hook.

18. The device as recited in claim 17, wherein the compartment and the casing include first and second connecting ports respectively, each connected to the controller and to the at least one motorized rotating element respectively, for the interconnection of the controller and the at least one motorized rotating element via a removable connector.

19. The device as recited in claim 17, wherein the compartment is a briefcase.

20. The device as recited in claim 17, wherein the compartment further includes a battery for energizing the controller and the at least one motorized rotating element via the controller.

21. The device as recited in claim 20, wherein the battery is a lead-type battery.

22. The device as recited in claim 10, wherein the casing includes a removable cover.

23. The device as recited in claim 10, wherein the casing includes a handle near the upper side thereof.

24. The device as recited in claim 10, wherein the casing includes at least one drain hole.

25. The device as recited in claim 10, further comprising first and second indicator lights that are mounted to the casing, each adjacent a respective first and second rotating elements; the first and second indicator lights being coupled to the controller so as to be controlled thereby to provide indication of rotational direction of the at least one motorized rotating element.

26. The device as recited in claim 1, wherein the first and second rotating elements are mounted to the casing near the upper side thereof.

27. A removable remotely controllable device for rotating a steering wheel having an outer edge, the device comprising:

a body;

first and second wheels that are mounted to the body and that defines with the body hooks for mounting the body on the steering wheel via its outer edge; at least one of the two wheels being motorized; the body being configured for resting on the front of the steering wheel while the first and second rotating elements are operatively mounted onto the outer edge of the steering wheel for transmission of rotation of the rotating elements to the steering wheel; the first and second wheels being selected from the group consisting of U-shaped wheels and V-shaped wheels;

at least one friction-reducing element, mounted to the body via an arm that extends downwardly from the body so that the at least one friction-reducing element is substantially laterally centered between the first and second wheels, for contacting the steering wheel when the body rests on the front of the steering wheel; the distal end of the arm including an attaching element;

a compartment that is removably mountable to the attaching element of the arm;

a controller that is housed in the compartment and that is connectable to the at least one motorized wheel for controlling the least one motorized wheel; and a battery that is housed in the compartment and that is connected to the controller for powering the controller and the at least one motorized wheel via the controller.

* * * * *